United States Patent [19]

Penny

[11] Patent Number: 4,557,632

[45] Date of Patent: Dec. 10, 1985

[54] COMPACTING APPARATUS

[75] Inventor: Charles Penny, Belleville, Ill.

[73] Assignee: Bernard M. McMenamy, St. Charles, Mo.

[21] Appl. No.: 562,192

[22] Filed: Dec. 15, 1983

[51] Int. Cl.[4] ..... E02D 3/02; E02D 5/18; E02D 29/00

[52] U.S. Cl. ..... 405/267; 405/269; 405/271; 299/11

[58] Field of Search ..... 405/50, 128, 238, 240, 405/248, 258, 266, 267, 269, 271, 288; 299/11, 12; 239/427.3, 427.5, 428, 558; 406/136, 144

[56] References Cited

U.S. PATENT DOCUMENTS

| | | | |
|---|---|---|---|
| 642,545 | 1/1900 | Chapman | 239/588 X |
| 2,372,957 | 4/1945 | Keefer | 406/136 X |
| 2,684,231 | 7/1954 | Pomykala | 239/558 X |
| 3,207,492 | 9/1965 | Zikesch | 239/317 X |
| 3,252,658 | 5/1966 | Coy | 239/428 |
| 3,641,775 | 2/1972 | Godley et al. | 405/50 |
| 3,707,848 | 1/1973 | Chelminski | 405/240 X |
| 3,786,639 | 1/1974 | Pineno et al. | 405/267 |

*Primary Examiner*—Cornelius J. Husar
*Assistant Examiner*—Nancy J. Stodola
*Attorney, Agent, or Firm*—Harvey B. Jacobson

[57] ABSTRACT

A compacting apparatus is provided and includes a material supply line having an upright inlet portion and a transversely disposed lower outlet portion provided with a discharge opening at its discharge end. The lower outlet portion is supplied with high pressure air from an air supply line which includes an outlet end portion disposed coaxially within the lower outlet portion of the material supply line and is provided with a nozzle assembly for directing pressurized jets of air toward the discharge opening. The material supply line upper inlet and lower outlet portions, each, are provided with a circumferential air chamber operative to discharge air jets into the material supply line in a downstream direction about the outer periphery thereof and the air jets discharged from the circumferential air chamber provided on the lower outlet end portion of the material supply line coact with the aforementioned nozzle assembly air jets and are disposed immediately downstream from nozzle assembly air jets to facilitate the flow of material through the outlet end portion of the supply line and the discharge opening thereof, the discharge opening being reduced in inside diameter relative to the inside diameter portion of the material supply line in which the nozzle assembly and adjacent circumferential air chamber are disposed.

4 Claims, 8 Drawing Figures

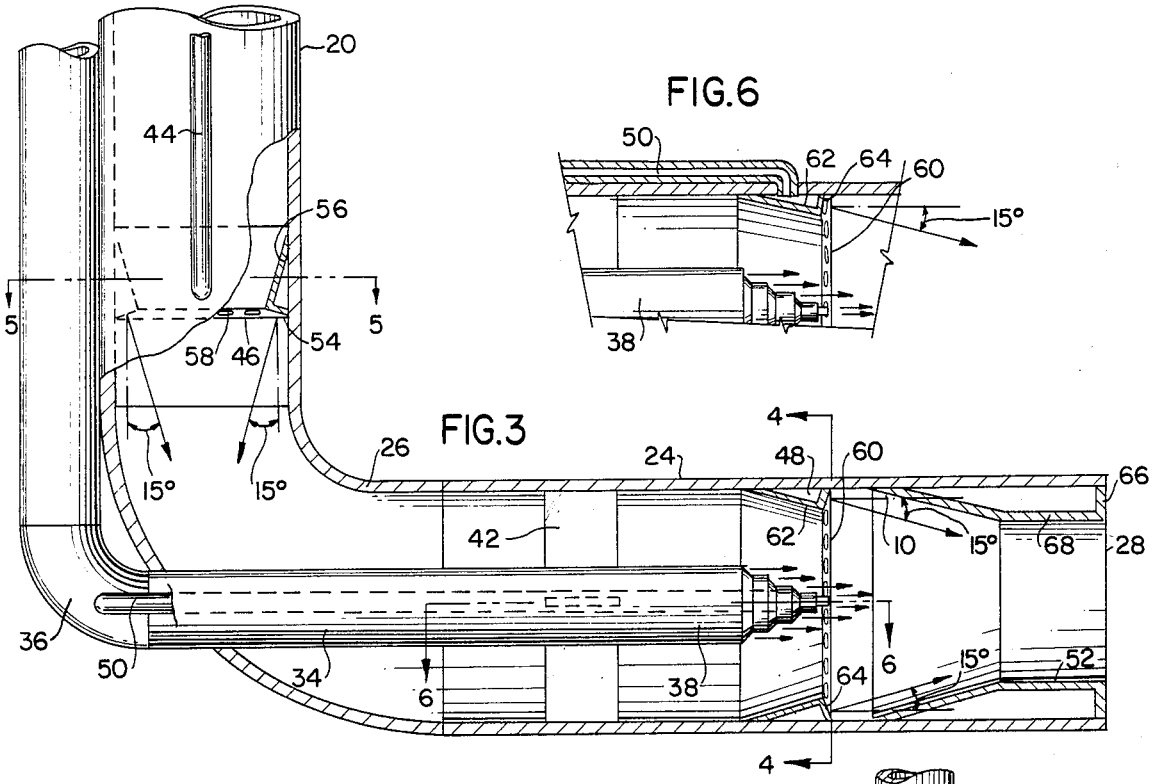
FIG.3
FIG.6
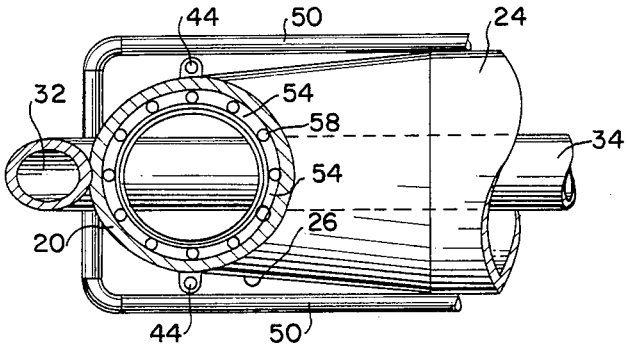
FIG.5
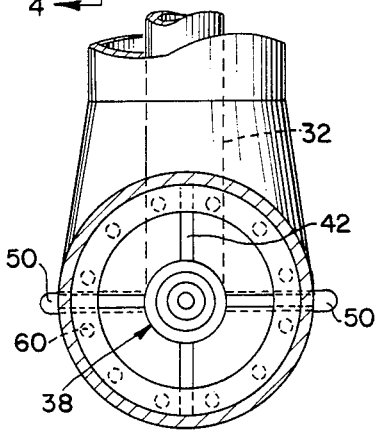
FIG.4
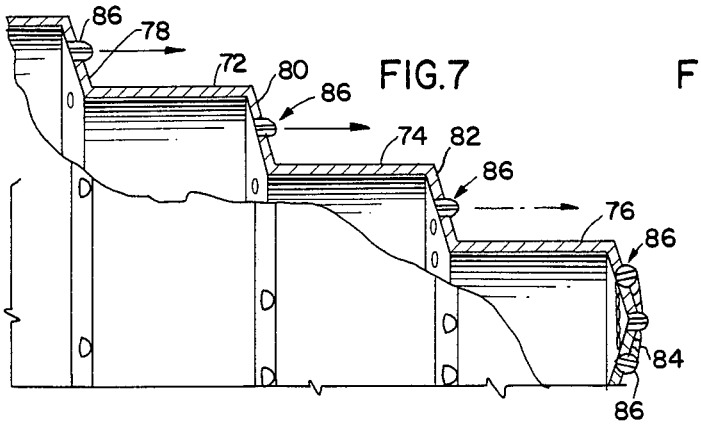
FIG.7
FIG.8
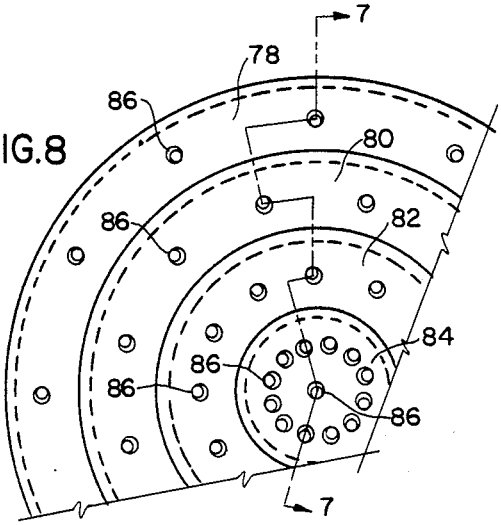

COMPACTING APPARATUS

BACKGROUND OF THE INVENTION

This invention relates generally to a compacting apparatus and more particularly to an apparatus for placing fill material in an underground void.

Various different apparatus heretofore have been used for filling mine shafts and the like with granular material. An early example of apparatus of this kind is to be found in U.S. Pat. No. 1,391,678 which discloses an apparatus employing conventional high and low pressure pumps used to fill underground voids with concrete or grout and is limited to the use of compacting material which can be pumped in this manner. Another type of known apparatus delivers a slurry of earth and water by gravity into subterranean cavities. Gravity feed obviously has limitations and is unsuitable in those instances in which gravity forces alone are insufficient to accomplish the compacting operation. More rdiscloses apparatus for impelling granular material against the sides of a passage by repeated impulses of pressurized air. This apparatus utilizes an outer casing to supply aggregate material into a cavity and utilizes air pressure to assist in the delivery of the material. However, this apparatus appears to be limited to a specialized work of the kind described and is structurally different and operates in a different manner from the present device. In addition to the above noted prior patents various other structures for filling underground cavities as well as structures including some of the general structural and operational features of the instant invention are disclosed in U.S. Pat. Nos. 2,372,957, 2,555,238, 2,684,231, 2,987,211, 3,207,492, 3,641,775 and 3,786,639.

SUMMARY OF THE INVENTION

The compacting apparatus of the instant invention provides a means of delivering fill material into subterannean cavities by a combination of gravity and air pressure rather than by direct pumping of the fill material.

The apparatus provides a material supply line having an inlet opening for receiving the fill material and a discharge opening for delivering fill material into the cavity. A primary air supply line is provided having a forward portion mounted within the material supply line and the forward outlet end portion of the primary air supply line includes a nozzle assembly directing pressurized air jets toward the discharge opening of the material supply line.

The material supply line includes an upstanding upper portion for receiving fill material and a lower, transversely disposed portion having a first base end thereof connected to the lower end of the upstanding portion and the above mentioned discharge opening at the remote free end thereof. The primary air supply line includes an upper substantially vertical portion disposed exteriorly of the upstanding upper portion of the material supply line and a lower transverse portion disposed coaxially within the transverse portion of the material supply line and terminating at the aforementioned nozzle assembly.

The lower transverse portion of the material supply line includes a circumferential chamber disposed therewithin substantially radially aligned with the discharge nozzle and which is provided with air under pressure and operative to discharge pressurized air therefrom at points spaced circumferentially thereabout in a downstream direction. The upper portion of the material supply line also includes an internal circumferential chamber supplied with pressurized air and also operative to discharge circumferentially spaced jets of air therefrom in a downstream direction within the material supply line.

The aforementioned nozzle assembly includes a stepped head portion having a plurality of transversely disposed annular portions each including outlet apertures each directing jet air generally in the direction of the discharge opening of the material supply line. The material supply line transverse portion includes a closed circumferentially disposed chamber having a convergent portion defining the discharge opening.

The outlet apertures of the nozzle assembly are directed toward the discharge opening in substantially parallel relation, and the outlet apertures of the circumferential chamber adjacent the nozzle assembly are directed generally toward the discharge opening at a convergent angle of inclination to the longitudinal axis of the transverse portion of the material supply line.

The diameter of the lower portion of the material supply line is substantially greater than the diameter of the upper portion thereof in order to provide a net cross-sectional area in the lower portion of the material supply line sufficient to insure continuous flow of material through the upper and lower portions of the material supply line.

The main object of this invention is to provide a compacting apparatus which will be operative to place fill material in underground voids from the ground surface.

Another object of this invention is to provide an apparatus for filling underground voids and wherein the fill material is in the form of fluent granular material such as soil and is conducted through a material supply line extending downward into the ground to a lower level thereof from the surface of the ground and which therefore functions to convey fill material through the line by gravity with the material supply line terminating downwardly in a horizontally directed lower end portion having central and outer circumferential air jet structure supported therefrom whereby fill material may be conveyed through the horizontal discharge end of the line independent of the gravity acting upon the fill material extending downwardly through the upstanding inlet end portion of the material supply line to thereby prevent unwanted compaction of the fill material adjacent the intersection of the lower end of the upstanding inlet portion of the material supply line and the horizontal discharge end of the material supply line in which the aforementioned air jet structure is disposed.

A final object of this invention to be specifically enumerated herein is to provide a material compacting apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an enlarged fragmentary vertical sectional view of the lower discharge end of the apparatus;

FIG. 4 is a transverse vertical sectional view taken substantially upon the plane indicated by the section line 4—4 of FIG. 3;

FIG. 5 is a horizontal sectional view taken substantially upon the plane indicated by the section line 5—5 of FIG. 3;

FIG. 6 is a fragmentary vertical sectional view taken substantially upon the plane indicated by the sectional line 6—6 of FIG. 3;

FIG. 7 is an enlarged fragmentary vertical sectional view of the nozzle assembly carried by the discharge end of the air supply line; and FIG. 8 is an enlarged fragmentary front elevational view of the nozzle assembly.

DETAILED DESCRIPTION OF THE INVENTION

Figure 1:
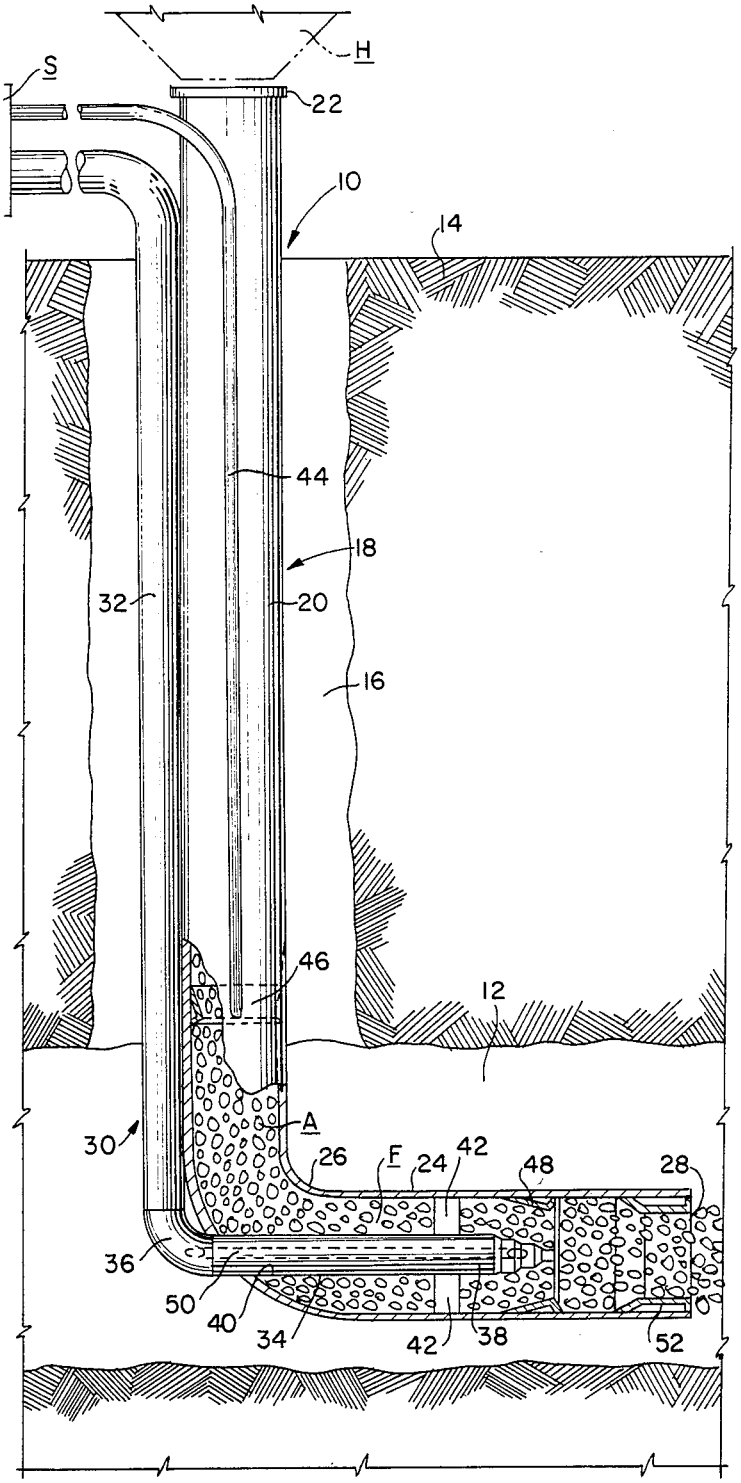
FIG. 1 is an elevational view of the compacting apparatus with parts broken away and illustrated in vertical section in order to illustrate the structure of the internal components thereof at the discharge end of the compacting apparatus.
Figure 2:
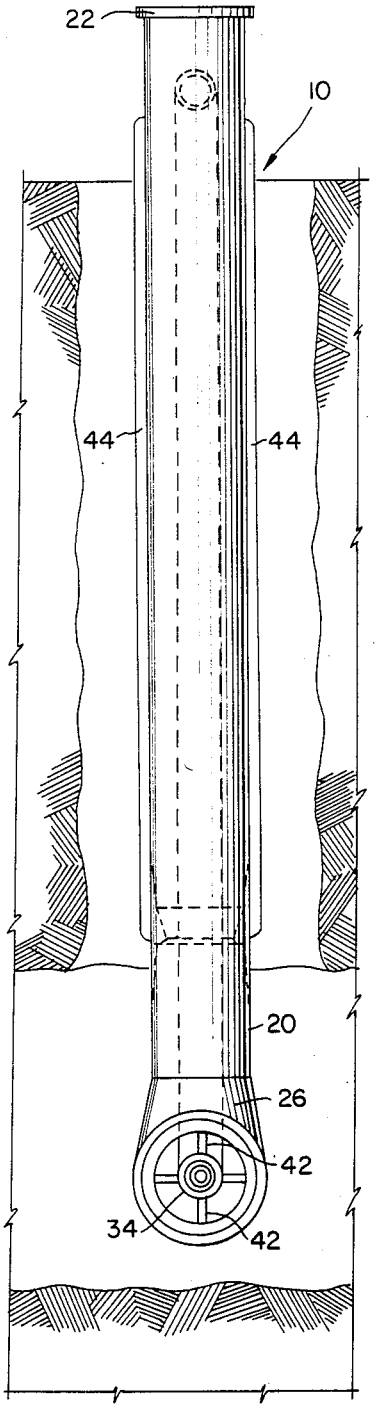
FIG. 2 is a front elevational view of the compacting apparatus as seen from the material discharge end thereof.

Referring now more specifically to the drawings, the numeral 10 generally designates the compacting apparatus. The compacting apparatus is used primarily for filling subterranean cavities such as an underground mine tunnel 12 which communicates with the surface 14 of the ground by a vertical shaft 16.

The compacting apparatus 10 includes a material supply line 18 having an upright inlet end portion 20 incorporating an inlet opening 22 at the upper end thereof for receiving fill material F from a hopper H. The lower end of the upright portion 20 terminates downwardly in a transverse portion 24 of somewhat greater diameter than the diameter of the upright portion 20. The transverse portion 24 includes a transition elbow 26 at its inlet end providing a connection between the transverse and upright portions 24 and 20 and a discharge opening 28 is defined at the end of the transverse portion 24 remote from the elbow.

Pressurized air is supplied to the interior of the material supply line 18 from an air supply S which includes a main air line 30 including an upper end portion 32 extending downwardly along the exterior of the upright inlet portion 20 of the material supply line 18 and a transverse forward or discharge portion 34 projecting into and disposed substantially coaxially within the transverse portion 24 of the material supply line 18. The transverse portion 34 includes a transition elbow at 36 at its inlet end providing a connection between the transverse portion 24 and the upright portion 32 and the end of the transverse portion 34 remote from the elbow 36 terminates in a noozle assembly referred to in general by the reference numeral 38.

The elbow 26 includes an opening 40 receiving the transverse portion 34 of the supply line 30 therethrough and the transverse portion 34 is mounted within the transverse portion 24 by a plurality of radial support brackets 42. The air supply S also includes a pair of secondary high pressure lines 44 which extend downwardly along the exterior of the upright portion 20 of the material supply line 18. The interior of the upright portion 20 includes a circumferential air chamber 46 having an annular configuration and a similar circumferential chamber is also provided at 48 in the transverse portion 24 of the material supply line 18. The chamber 48 is in close proximity to the nozzle assembly 38 and is supplied with pressurized air from a pair of branch lines 50 connected between the chamber 48 and the main air line elbow 36. The material supply line discharge opening 28 is reduced in diameter relative to the diameter of transverse portion 24 and is defined by a closed chamber 52 of annular configuration.

As clearly shown in FIGS. 3 and 5, the supply line upright and transverse portions 20 and 24 are formed of generally cylindrical tubular members. The circumferential chamber 46 which is supplied air from secondary air lines 44 is formed from interconnected forward and rear plates 54 and 56 attached, as by welding, to the inside wall of the material supply line upright portion 20 and the forward plate 54 includes a plurality of air outlet apertures 58, twelve in number in the preferred embodiment as shown in FIG. 5, which are convergently inclined at 15° relative to the longitudinal axis of the upright portion 20. The circumferential chamber 48 in the vicinity of the nozzle 38 is also defined by interconnected forward and rearward truncated cone-shaped plates 60 and 62 and the forward plate is provided with a plurality of nozzle 64, twelve in number in the preferred embodiment as shown in FIG. 4, which are convergently inclined at 15° relative to the longitudinal axis of the transverse portion 24. The closed chamber 52 defining the discharge opening is provided by interconnected front, intermediate and rear plates 66, 68 and 70, respectively, attached to the inside wall of the material supply line transverse portion 24.

The nozzle assembly 38 is clearly illustrated in FIGS. 7 and 8 and is formed into a stepped configuration by coaxially related cylindrical plates 72, 74 and 76 interconnected by annular plates 78, 80 and 82 and an end plate 84. Each of the annular plates 78, 80 and 82 and the end plate 84 is apertured to receive a plurality of nozzles which, in the preferred embodiment, are disposed in substantially parallel relation to the longitudinal axis of the main air line transverse portion 34.

It is thought that the structural features and functional advantages of this compacting apparatus have become fully apparent from the foregoing description of parts but for completeness of disclosure, the operation of the apparatus will be briefly described.

The fill material F, which is usually aggregate, sand or similar granular material, is placed within the material supply line 18 at the upper inlet opening 22. The material is continuously supplied from the hopper H, builds up in the material supply line and is discharged from the end opening 28 by high pressure air supplied to the interior of the material supply line 18 from the supply S.

Air is supplied into the material supply line upright portion 20 by the secondary air lines 44 which supply air under pressure to the circumferential chamber 46 to be issued from the nozzles 58. This chamber and the air issuing from the nozzles 58 provides, in effect, a material force ring which tends to agitate the material and urge it downwardly into the material supply line transverse portion 24.

The cross-sectional area of the material supply line transverse forward portion 24 is greater than the cross-sectional area of the upright portion 20 to compensate for the reduction in area caused by the presence of the coaxial main air line forward end portion 40. The aggregate F is further urged outwardly through the discharge opening by the nozzle assembly 38 which supplies pressurized air in a direction paralleling the material supply line transverse portion 34 and by the circumferential chamber 48 which supplies air at a generally convergent angle. The chamber 48 provides a choke effect and the aggregate material is further pressurized and accelerated by the change in the configuration of the material supply line transverse portion 24 in the vicinity of the nozzle assembly 28 and also from the reduction in the cross-sectional area of the closed chamber 52 which likewise provides a choking effect at the discharge opening 28.

It will be understood that water pressure can be used, if desired, in lieu of air pressure and that water pressure can also be used to assist the passage of the aggregate fill material through the material supply line. However, inasmuch as many abandoned mine tunnels are subject to water flooding it is deemed that air under pressure will be the prime power source to insure that proper flow of aggregate or other fill material through the material supply line.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A compacting apparatus for use in charging earth cavities, said apparatus including a material supply line having an upright portion incorporating an upper end inlet for receiving the fill material and terminating downwardly in a generally horizontal transverse arm portion connected at one end to the lower end of said upright portion and extending outward therefrom and terminating at its other end in a discharge opening in spaced remote relation from said upright portion, air supply means including an air line incorporating a forward discharge portion mounted within the material supply line transverse arm portion, said forward discharge portion including nozzle means disposed within said horizontal arm portion and directed in a downstream direction toward the discharge opening of material supply line, said material supply line transverse arm portion including a circumferentially disposed chamber to which air is supplied from said air supply line and disposed substantially in the vicinity of said nozzle means, said chamber having a a plurality of air outlet openings directing air into the material supply line in a downstream direction toward said discharge opening, said material supply line including an inner circumferential wall portion, said circumferentially disposed chamber including forward and rearward oppositely inclined truncated cone-shaped plates attached at their major diameter ends to said wall portion and to each other at their minor diameter ends, said forward plate including means defining said air outlet openings and being sharply forwardly and outwardly inclined, said rear plate being only slightly forwardly and inwardly inclined, the diameter of said transverse portion of the material supply line being greater than the diameter of the upright portion thereof to provide a net cross-sectional area of said transverse portion substantially as great as the cross-sectional area of said upright portion to facilitate flow through said transverse portion of said material supply line, the transverse portion of the material supply line including a diametrically reduced end portion downstream from said chamber and nozzle means defining said discharge opening, said discharge opening being of substantially the same inside cross-sectional area as said upright portion.

2. The compacting apparatus of claim 1 wherein said upright portion of said material supply line includes a circumferentially disposed chamber supplied by air by said air supply means and having a plurality of air outlet openings directed air into the outer periphery of said material supply line in a downstream direction, said air chamber also being formed by forward and rearward oppositely sharply and slightly inclined plates corresponding to the first mentioned plates.

3. The compacting apparatus of claim 1 wherein said air line includes an upright portion disposed exteriorly of said material supply line and a transverse portion coaxially mounted within the transverse portion of said material supply line, said transverse portion of said air line comprising said forward portion thereof.

4. The compacting apparatus of claim 1 wherein said nozzle means is substantially coaxial with the material supply line transverse portion and includes a stepped head portion having a plurality of annular portions decreasing in size in the direction of flow of material through said material supply line with each annular portion including a plurality of outlet apertures discharging air generally in the direction of the discharge opening of the transverse portion of said material supply line.

* * * * *